US005388350A

United States Patent [19]

Parker, Jr.

[11] Patent Number: 5,388,350

[45] Date of Patent: Feb. 14, 1995

[54] ROLLER SHOE CONSTRUCTION

[76] Inventor: Bill H. Parker, Jr., 2171 Peachtree Cir., Pittsburg, Calif. 94565

[21] Appl. No.: 999,272

[22] Filed: Dec. 31, 1992

[51] Int. Cl.[6] ..... A43B 5/00; A43B 5/04; A63C 17/00; A63C 17/14

[52] U.S. Cl. ..... 36/115; 280/11.19; 280/11.21; 36/114

[58] Field of Search ..... 280/11.19, 11.21, 11.22, 280/11.23; 36/113, 114, 115, 116

[56] References Cited

U.S. PATENT DOCUMENTS

| | | | |
|---|---|---|---|
| 338,070 | 3/1886 | Heacock | 280/11.19 |
| 2,165,996 | 7/1939 | Chiles | 280/11.21 X |
| 2,679,401 | 5/1954 | Williams | 280/11.23 |
| 2,944,827 | 7/1960 | Makara | 280/11.23 X |
| 3,306,623 | 2/1967 | Weitzner | 280/11.19 X |
| 4,273,345 | 6/1981 | Ben-Dor et al. | 280/11.22 X |
| 4,289,323 | 9/1981 | Roberts | 280/11.21 |
| 4,334,690 | 6/1982 | Klamer et al. | 280/11.21 |
| 4,578,883 | 4/1986 | Dassler | 36/116 |
| 4,691,453 | 9/1987 | Tifre | 36/115 X |
| 4,694,591 | 9/1987 | Banich et al. | 36/30 R X |

FOREIGN PATENT DOCUMENTS

| | | | |
|---|---|---|---|
| 2304853 | 2/1973 | Germany | 280/11.19 |
| 2821644 | 11/1979 | Germany | 36/114 |

*Primary Examiner*—Paul T. Sewell
*Assistant Examiner*—BethAnne C. Cicconi
*Attorney, Agent, or Firm*—E. Michael Combs

[57] ABSTRACT

A roller shoe includes a shoe upper having a first sole mounting a second sole, with the second sole including a plurality of spaced parallel roller cylinders mounted to the second sole projecting therefrom to provide for a rolling surface relative to an underlying surface, with forward and rear ends of the second sole having brake resilient lugs projecting therefrom.

2 Claims, 4 Drawing Sheets

ROLLER SHOE CONSTRUCTION

BACKGROUND OP THE INVENTION

1. Field of the Invention

The field of invention relates to skate apparatus, and more particularly pertains to a new and improved roller shoe construction wherein cylindrical rollers are mounted within the sole portion of the associated shoe.

2. Description of the Prior Art

Shoes employing rollers to the sole structure are available in the prior art and exemplified by the U.S. Pat. Nos. 4,928,982; 4,295,655, 4,988,122; and 3,983,643.

The instant invention attempts to overcome deficiencies of the prior art by providing for a roller shoe construction incorporating spaced roller cylinders mounted in a coextensive relationship relative to the shoe sole and supported within the sole construction of the shoe and in this respect, the present invention substantially fulfills this need.

SUMMARY OF THE INVENTION

In view of the foregoing disadvantages inherent in the known types of roller shoe apparatus now present in the prior art, the present invention provides a roller shoe construction wherein the same is arranged to mount roller cylinders within a shoe sole. As such, the general purpose of the present invention, which will be described subsequently in greater detail, is to provide a new and improved roller shoe construction which has all the advantages of the prior art roller skate apparatus and none of the disadvantages.

To attain this, the present invention provides a roller shoe including a shoe upper having a first sole mounting a second sole, with the second sole including a plurality of spaced parallel roller cylinders mounted to the second sole projecting therefrom to provide for a rolling surface relative to an underlying surface, with forward and rear ends of the second sole having brake resilient lugs projecting therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roller shoe construction which has all the advantages of the prior art roller skate apparatus and none of the disadvantages.

It is another object of the present invention to provide a new and improved roller shoe construction which may be easily and efficiently manufactured and marketed.

It is a further object of the present invention to provide a new and improved roller shoe construction which is of a durable and reliable construction.

An even further object of the present invention is to provide a new and improved roller shoe construction which is susceptible of a low cost of manufacture with regard to both materials and labor, and which accordingly is then susceptible of low prices of sale to the consuming public, thereby making such roller shoe constructions economically available to the buying public.

Still yet another object of the present invention is to provide a new and improved roller shoe construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
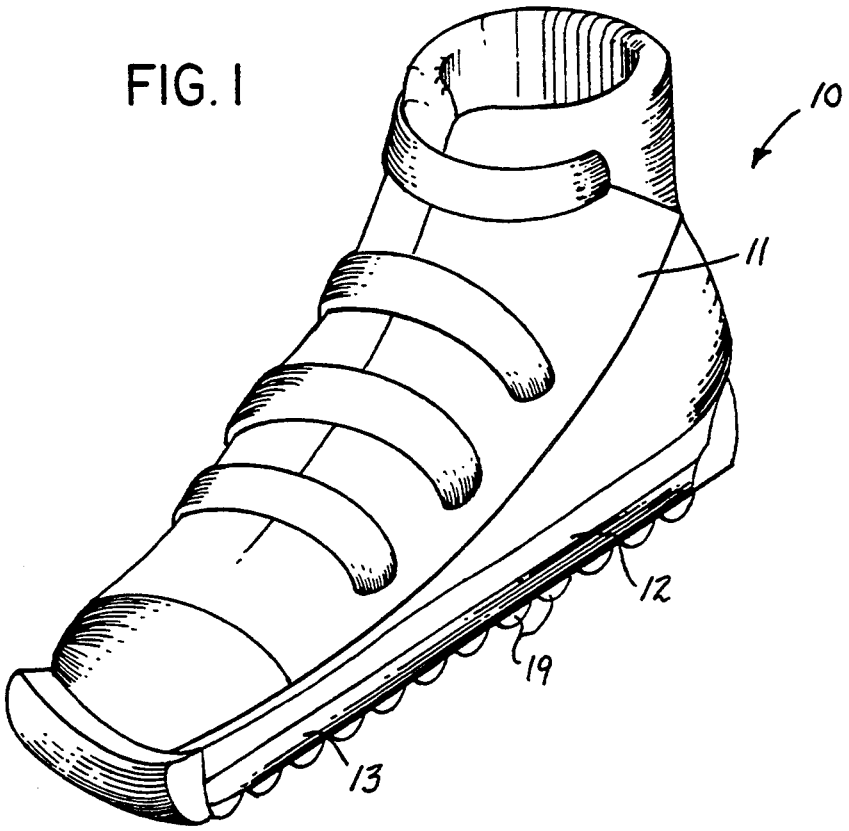
FIG. 1 is an isometric illustration of the invention.
Figure 2:
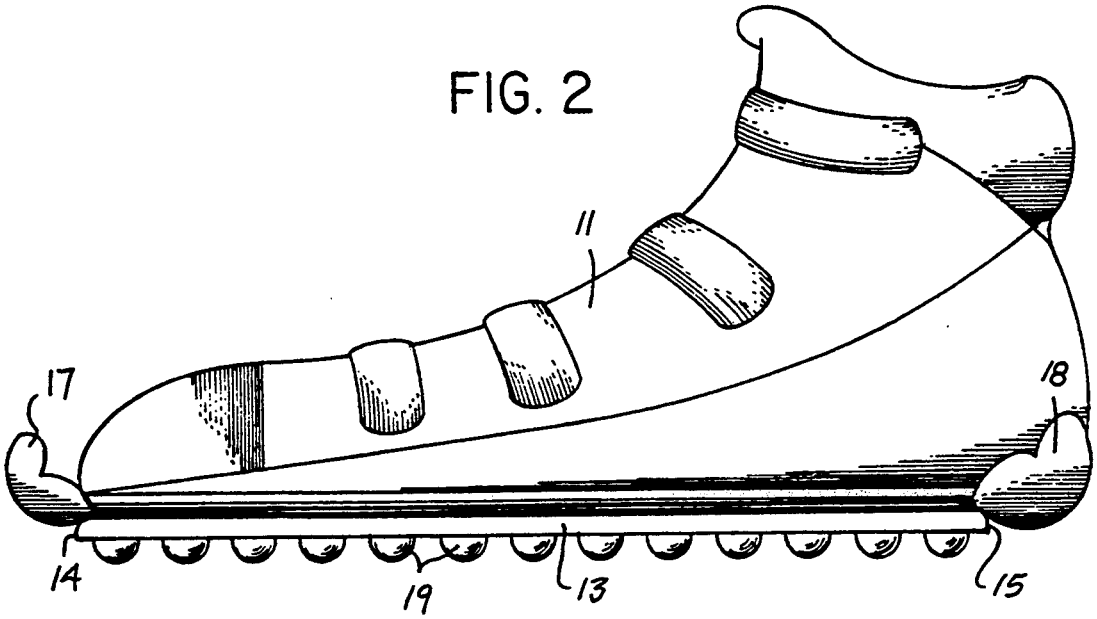
FIG. 2 is an orthographic side view of the invention.
Figure 3:
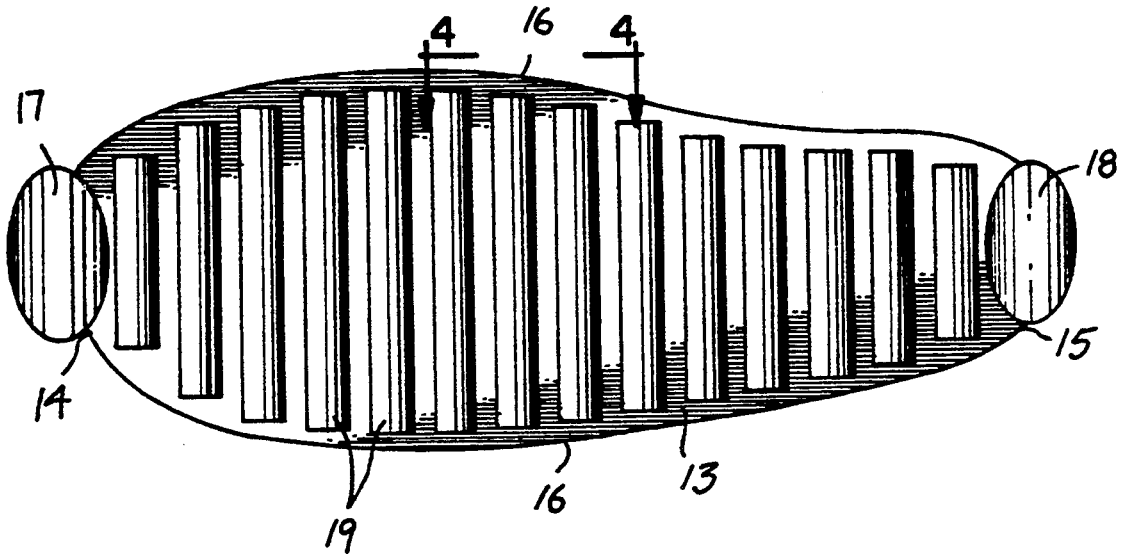
FIG. 3 is an orthographic bottom view of the invention.

With reference now to the drawings, and in particular to FIGS. 1 to 9 thereof, a new and improved roller shoe construction embodying the principles and concepts of the present invention and generally designated by the reference numeral 10 will be described.

More specifically, the roller shoe construction 10 of the instant invention essentially comprises a shoe upper 11, having a shoe sole 12 of a first durometer hardness, with the shoe sole 12 including a shoe plate 13 of a second durometer hardness greater than the first durometer hardness, that includes a forward end 14 spaced from a rearward end 15 and spaced sides 16. First resilient boss lug 17 extends from the forward end 14, with a second resilient boss lug 18 from the rearward end 15. The lugs 17 and 18 are arranged to function as braking pads relative in use of the organization, where an individual merely pivots about a forwardmost or rearwardmost roller 19 to effect engagement of one of the lugs relative to an underlying support surface. The rollers 19 include a plurality of spaced parallel rollers 19 coextensively directed between the forward end and the rear end 15 mounted within the sole plate 13. The sole plate includes a sole plate bottom surface 20 receiving the rollers therewithin.

Figure 4:
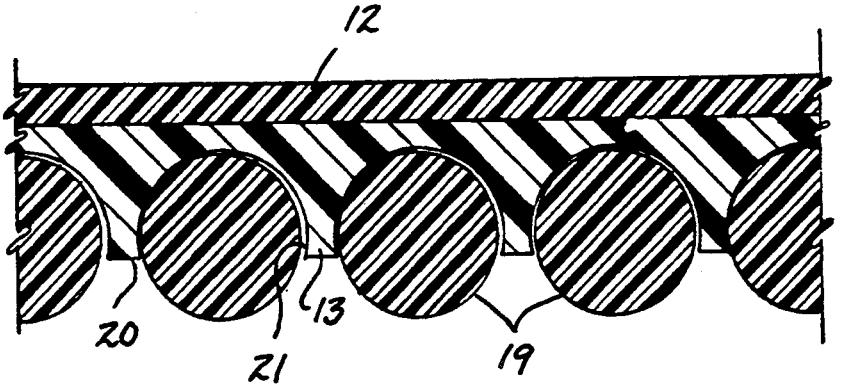
FIG. 4 is an orthographic view, taken along the lines 4—4 of FIG. 3 in the direction indicated by the arrows.
Figure 5:
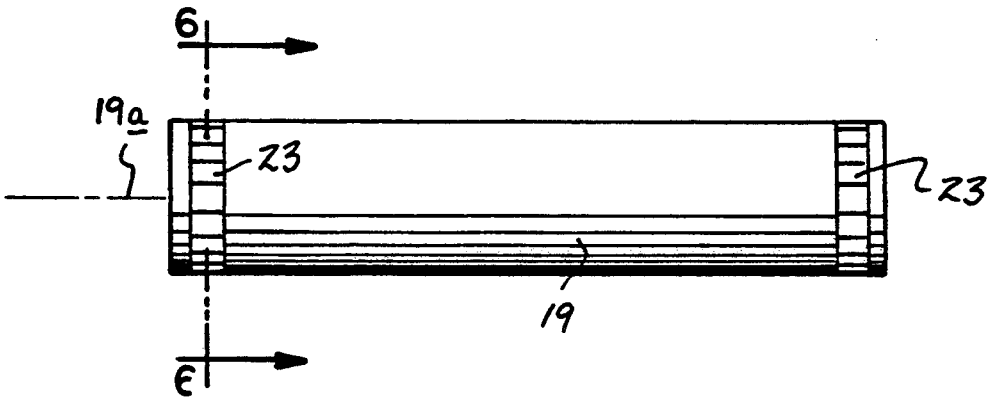
FIG. 5 is an orthographic side view of a modified roller cylinder.
Figure 6:
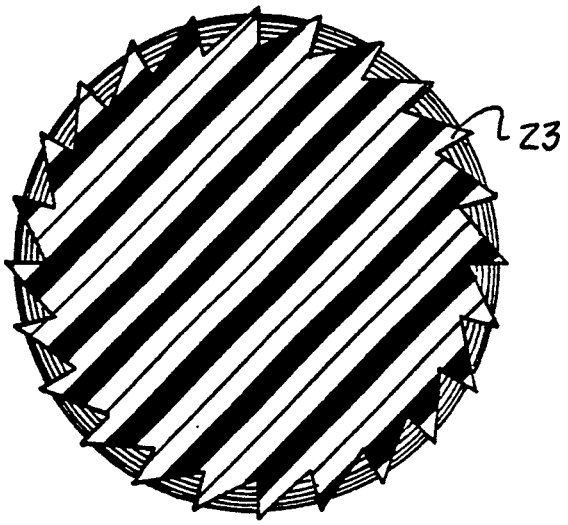
FIG. 6 is an orthographic view, taken along the lines 6—6 of FIG. 5 in the direction indicated by the arrows.
Figure 7:
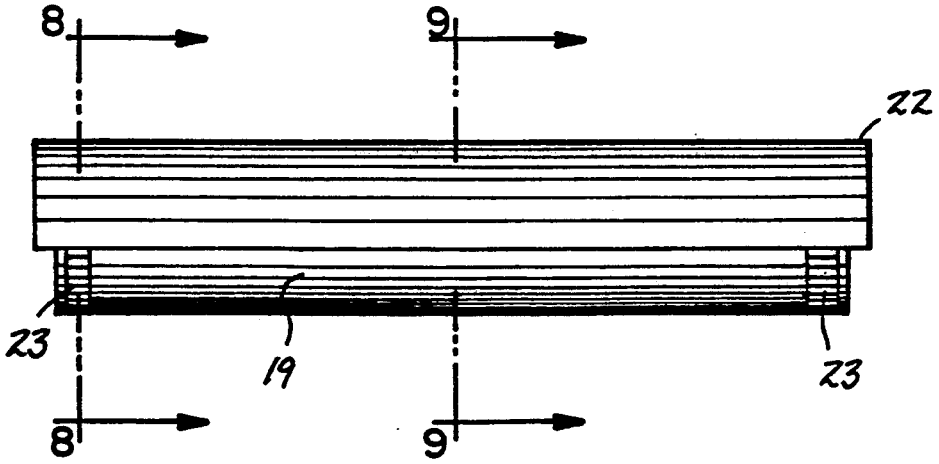
FIG. 7 is an orthographic side view of a support housing for each roller cylinder.
Figure 8:
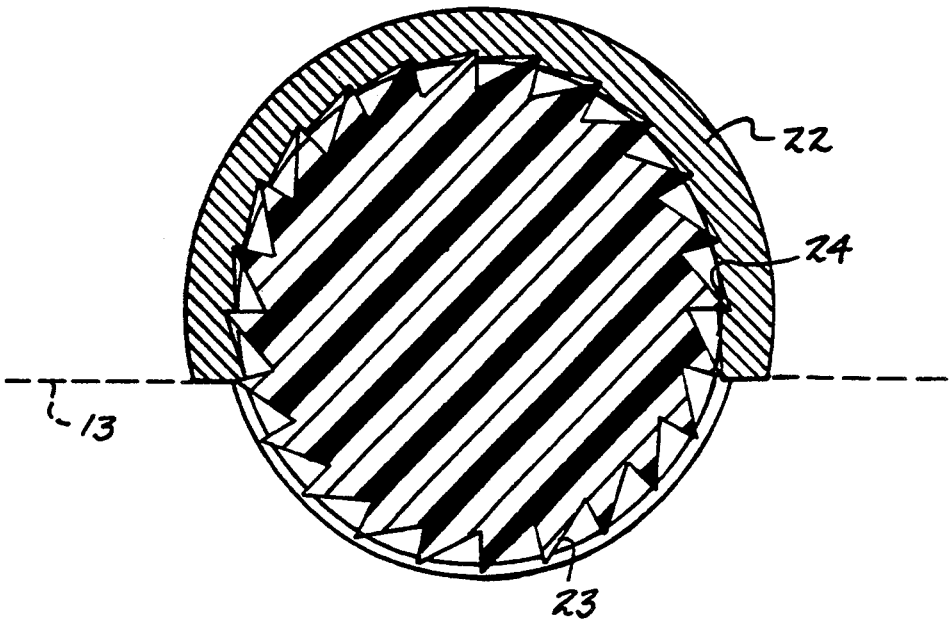
FIG. 8 is an orthographic view, taken along the lines 8—8 of FIG. 7 in the direction indicated by the arrows.
Figure 9:
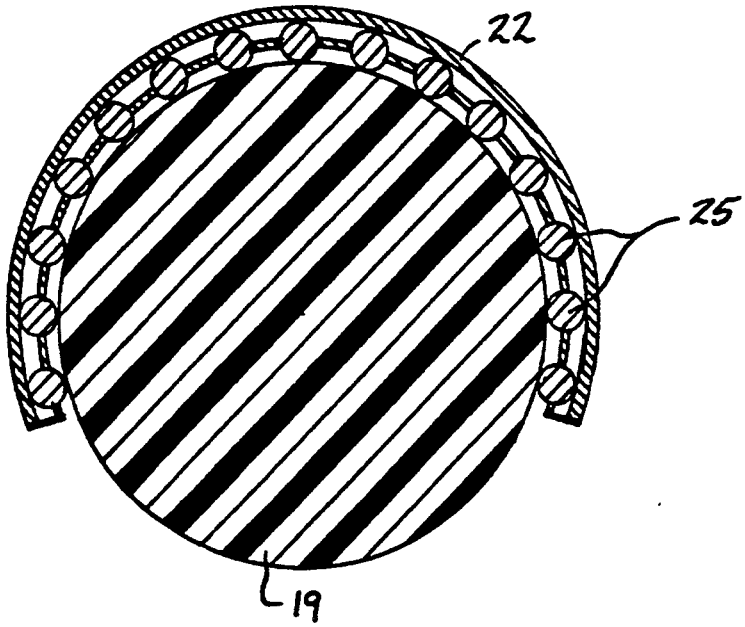
FIG. 9 is an orthographic view, taken along the lines 9—9 of FIG. 8 in the direction indicated by the arrows.

The construction, as indicated in FIGS. 8 and 9 for example, employs a semi-cylindrical support 22 positioned within a respective semi-cylindrical cavity 21 of the sole plate 13. The semi-cylindrical cavities 21 are arranged in a parallel relationship, as indicated in FIG. 4 for example, with each semi-cylindrical cavity 21 receiving a roller 19. Typically, the semi-cylindrical cavities 21 define an arc greater than one hundred eighty degrees and less than two hundred sixty, and typically two hundred seventy degrees, of arc to secure the rollers rotatably therewithin. The use of semi-cylindrical support housings 22 each also define an arc greater than one hundred eighty degrees and less than two hundred sixty degrees and are complementarily received within each of the semi-cylindrical cavities 21. A ball bearing cage 25 is interposed between each of the semi-cylindrical support housings 22 and an associated roller 19, in a manner as indicated in FIG. 9. Further, the semi-cylindrical support housings 22 each include spaced annular arrays of ratchet teeth recesses 24 (see FIG. 8) cooperative with the resilient annular array of ratchet teeth 23. The ratchet teeth 23 are orthogonally oriented relative to the axis 19*a* of each roller to permit and maintain one-way rolling and rotation of each roller relative to the shoe construction to prevent rearward rotation of the rollers to permit forward motion only in use of the shoe construction as a safety feature. In this manner, individuals are not availed of rearward motion in use of the organization thus minimizing injuries due to the greater risk associated with rearward motion in a skating procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of tile principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roller shoe construction, comprising, a shoe upper, the shoe upper having a shoe sole mounted to the shoe upper, with the shoe sole having a first durameter of hardness, and a flexible shoe plate mounted coextensively to the shoe sole, wherein the shoe plate is formed of a second durameter hardness greater than the first durameter of hardness, and the shoe plate includes a forward end spaced from a rearward end, and spaced sides, and a row of spaced parallel semi-cylindrical cavities are directed into the shoe plate at spaced intervals coextensive with the shoe plate from the forward end to the rearward end, and each of the semi-cylindrical cavities includes a roller member rotatably mounted within each of the semi-cylindrical cavities, a resilient first boss lug mounted to the forward end extending forwardly of the shoe plate, and a resilient second boss lug mounted to the rearward end extending rearwardly of the shoe plate, wherein the first boss lug and the second boss lug are spaced above a shoe plate bottom surface, wherein pivoting of the shoe plate permits selective contact of the first boss lug and the second boss lug for braking, each of the semi-cylindrical cavities includes a semi-cylindrical support housing contained coextensively therewithin, each support housing defines an arc greater than one hundred eighty degrees and each semi-cylindrical support housing receives one of said rollers therewithin, and a roller bearing cage mounted coextensively between each support housing and each roller.

2. A roller shoe construction as set forth in claim 1 including at least one annular array of resilient ratchet teeth mounted to each roller, wherein each roller is symmetrically oriented about a predetermined axis, and the resilient ratchet teeth are orthogonally oriented relative to the axis, and each support housing includes an annular array of ratchet teeth recesses cooperative with a respective annular array of said ratchet teeth to provide for one-way rotation of each roller, wherein each roller is of a cylindrical construction.

* * * * *